US009173807B2

(12) United States Patent
Freeman

(10) Patent No.: US 9,173,807 B2
(45) Date of Patent: Nov. 3, 2015

(54) CPR DISPLAY FOR MONITOR/DEFIBRILLATOR WITH ASSISTED CPR

(75) Inventor: Curtis White Freeman, Windham, NH (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 457 days.

(21) Appl. No.: 13/201,793

(22) PCT Filed: Feb. 17, 2010

(86) PCT No.: PCT/US2010/024345

§ 371 (c)(1), (2), (4) Date: Aug. 16, 2011

(87) PCT Pub. No.: WO2010/096396

PCT Pub. Date: Aug. 26, 2010

(65) Prior Publication Data

US 2011/0301511 A1 Dec. 8, 2011

Related U.S. Application Data

(60) Provisional application No. 61/153,417, filed on Feb. 18, 2009.

(51) Int. Cl.
*A61H 31/00* (2006.01)

(52) U.S. Cl.
CPC ..... *A61H 31/005* (2013.01); *A61H 2201/5043* (2013.01); *A61H 2201/5061* (2013.01)

(58) Field of Classification Search
CPC ... A61H 31/00; A61H 31/004; A61H 31/007; A61H 31/005; A61H 2201/0157; A61H 2201/1253; A61H 2201/1619; A61H 2201/5043; A61H 2201/5058; A61H 2201/5079; A61H 2201/5061; A61H 2205/084; A61H 2230/04; A61H 2230/045; A61H 2230/06; A61H 2230/065; A61H 2230/08; A61H 2230/085; A61H 2230/30; A61H 2230/305; A61H 2230/40; A61H 2230/405; A61H 2230/42; A61H 2230/425; A61N 1/3925; A61N 1/3993
USPC ..... 601/DIG. 8, DIG. 10, 41–44; 434/265; 607/5; 600/509, 511, 514
See application file for complete search history.

(56) References Cited

U.S. PATENT DOCUMENTS 4,237,872 A 12/1980 Harrigan
4,797,104 A * 1/1989 Laerdal et al. ..... 434/265

(Continued)

FOREIGN PATENT DOCUMENTS

JP 2005230164 9/2005
JP 2005230164 A 9/2005

(Continued)

*Primary Examiner* — Quang D Thanh

(57) ABSTRACT

A CPR device includes a CPR meter which is placed on the sternum of a patient and against which chest compressions are applied during CPR. The chest compressions are sensed by the CPR meter and this information is supplied to a display device for the display of the progress of CPR. A graphical display is provided which graphically illustrates the progress of CPR during a current CPR interval in either elapsed time or chest compressions delivered, as compared with the total time of the CPR interval or the maximum number of chest compressions to be delivered. The display can be configured to display either elapsed time or chest compression count, and the total number of compressions to be applied and the total duration of the CPR interval can be selectively configured.

12 Claims, 6 Drawing Sheets

(56) References Cited

U.S. PATENT DOCUMENTS

| | | | | |
|---|---|---|---|---|
| 4,989,611 | A * | 2/1991 | Zanetti et al. | 600/508 |
| 5,239,988 | A * | 8/1993 | Swanson et al. | 601/41 |
| 6,155,257 | A * | 12/2000 | Lurie et al. | 600/534 |
| 6,224,562 | B1 * | 5/2001 | Lurie et al. | 601/41 |
| 6,306,107 | B1 | 10/2001 | Myklebust et al. | |
| 6,356,785 | B1 * | 3/2002 | Snyder et al. | 607/5 |
| 7,288,072 | B2 | 10/2007 | Stott et al. | |
| 2006/0116724 | A1 * | 6/2006 | Snyder | 607/5 |
| 2006/0270952 | A1 * | 11/2006 | Freeman et al. | 601/41 |
| 2007/0010764 | A1 | 1/2007 | Palazzolo et al. | |
| 2009/0024175 | A1 | 1/2009 | Freeman | |

FOREIGN PATENT DOCUMENTS

| | | | |
|---|---|---|---|
| JP | 2007503283 | A | 2/2007 |
| WO | 9519556 | A1 | 7/1995 |
| WO | 0215836 | A2 | 2/2002 |
| WO | 2006136974 | A2 | 12/2006 |
| WO | 2007093944 | A2 | 8/2007 |
| WO | WO 2007093944 | A2 * | 8/2007 |
| WO | 2008050590 | A1 | 5/2008 |
| WO | 2008086496 | A2 | 7/2008 |

* cited by examiner

CPR DISPLAY FOR MONITOR/DEFIBRILLATOR WITH ASSISTED CPR

This invention relates to medical instruments designed to assist in the delivery of or gauge the effectiveness of cardiopulmonary resuscitation (CPR) and, in particular, to a display for such instruments.

When a patient is stricken with sudden cardiac arrest, two types of treatment are required: CPR to oxygenate the blood and force a flow of blood through the vascular system, importantly to the brain, and defibrillation to restart the body's automatic electrical stimulation of the heart. Modern automatic external defibrillators (AEDs) and monitor/defibrillators assist an emergency medical technician (EMT) in providing both types of treatment. Defibrillation can be provided semi-automatically by pressing the shock button following automated analysis of the ECG waveform or manually by the EMT after observing the ECG waveform on the monitor. Instruments such as the Philips MRx monitor/defibrillator from Philips Healthcare of Andover, Mass. can also be set to a CPR mode or interval, during which assistance is given in the delivery of CPR and the results of CPR, chest compressions and ventilation, are monitored. Automated instruments such as the MRx monitor/defibrillator when operated in the automatic mode and AEDs from Philips Healthcare can also execute rescue protocols in which defibrillation shocks and periods of CPR are directed and carried out at appropriate times in accordance with the patient's vital signs.

Recent studies have shown that different patients may be resuscitated more effectively with different treatment regimens depending upon various factors. One factor which affects the likelihood of success of defibrillation is the amount of time that has elapsed since the patient experienced the arrhythmia ("downtime"). This research has indicated that, depending on the duration of cardiac arrest, a patient will have a better probability of recovery with one protocol as compared to another. If the AED or monitor/defibrillator is set up for a less effective protocol for the resuscitation of a particular patient, that patient's probability of recovery may be reduced. These studies have shown that some of these patients have a better chance of being resuscitated if CPR is performed first, which will start by providing externally driven circulation and ventilation which may bring the patient to a condition where application of a shock is more likely to be successful at restoring spontaneous circulation. Accordingly, some defibrillators guide the rescuer in the selection of the treatment protocol which experience has dictated will be more effective under the present patient conditions. See, for instance, international patent application publication WO 2006/136974.

In addition to providing intervals during which CPR is to be performed and helping a rescuer choose the treatment protocol likely to be most effective, more advanced defibrillators such as those mentioned above can guide a rescuer in the proper application of CPR as described in U.S. Pat. No. 6,306,107 (Myklebust et al.) These defibrillators are equipped with a pad or puck which a rescuer places on the chest of the patient and against which the rescuer delivers the chest compressions of CPR. The chest compressions are often applied in synchronism with a rhythmic tone produced by the instrument. Since the depth of chest compressions is the best non-invasive indicator of blood flow, the pad or puck includes an accelerometer which is used to measure the depth of each compression as well as the rate of the compressions. If the accelerometer signals indicate that CPR is being improperly delivered, the defibrillator will issue audible instructions directing the rescuer to "compress deeper" or to "compress faster," thereby guiding the rescuer in the proper delivery of the CPR compressions. In addition to monitoring chest compressions, some of these instruments also monitor ventilation by the changes in the patient's thoracic impedance. If ventilation is being improperly administered the instrument can issue audible instructions to "ventilate more" or "ventilate less."

Consequently, as the rescuer is working hard to deliver chest compressions of the proper depth (generally about 6 cm.) and at the proper rate, (generally around 100 compressions per minute), the rescuer is receiving a constant stream of prompts and information from the CPR instrument. At the same time, the rescuer is trying to keep track of the elapsed time of CPR and of the total number of chest compressions administered, as rescue protocols are generally designed with these parameters as overall objective. It would be desirable to provide this information to the rescuer in a simple way that can be ascertained at a glance, so that the rescuer can quickly see the progress of the rescue while being guided by the chest compression rate and depth prompting.

In accordance with the principles of the present invention, a CPR meter is provided that tracks and displays the progress of administration of CPR. The device can be programmed with one or more rescue protocols to be followed by a rescuer, including the duration of one or more CPR intervals and the number of compressions to be administered during the CPR intervals. As chest compressions are being administered, the device visually displays the progress of CPR by the number of compressions delivered, the elapsed time of the administration of CPR, or both. In a constructed embodiment this information is displayed in the form of a CPR progress bar. As the rescuer administers CPR compression, the rescuer can see at a glance the amount of time or compressions delivered or remaining to be delivered for the current CPR interval. Subsequent CPR intervals can be of equal or different durations or compressions delivered, in accordance with the pre-selected CPR protocol of the device.

Figure 1:
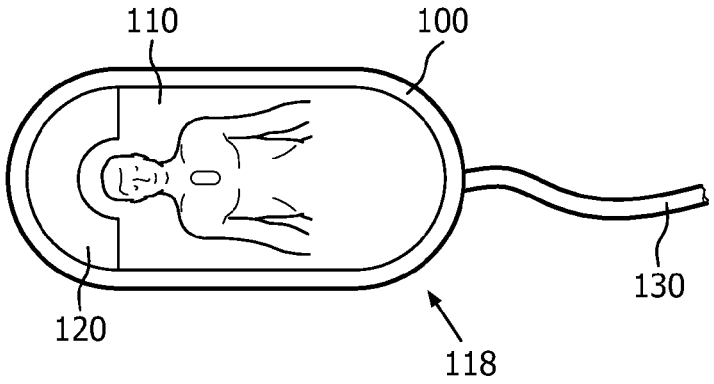
FIG. 1 illustrates a CPR meter for the administration of measured chest compression against the chest of a patient.

FIG. 1 illustrates a CPR meter 100 which is used to monitor and guide proper CPR chest compressions according to an embodiment of the present invention. The CPR meter 100 is operable to coach a rescuer in administering CPR to a patient, such as providing feedback on whether chest compressions are of sufficient depth and whether the pace or rate of the chest compressions is adequate. In addition to providing CPR coaching to a rescuer, the CPR meter 100 may include one or more sensors for sensing physiological characteristics, such as a patient's pulse, of the patient to whom the CPR meter 100 is attached and to whom CPR is being administered by the rescuer. Including a sensor in the CPR meter 100 takes advantage of its position on the patient's chest to sense and gather physiological information related to the sensed physiological characteristic. The same information can then be used in conjunction with other acquired physiological information to create a more specific resuscitation protocol for that particular patient.

An upper portion 120 of a housing 118 of the CPR meter 100 is shown in FIG. 1. An illustration 110 depicting a patient's torso is included on the upper portion 120 of the CPR meter 100 to illustrate the position and orientation of the CPR meter 100 on the patient. In this position the lower portion of the device 100 opposite the upper portion 120 is in contact with the torso of the patient. A cable 130 is used to transfer the physiological information and compression signals to a medical device, such as a defibrillator/monitor, to which the CPR meter 100 is attached. Alternatively, the CPR meter may communicate wirelessly with the defibrillator/monitor as by Bluetooth r.f. communication.

Figure 2:
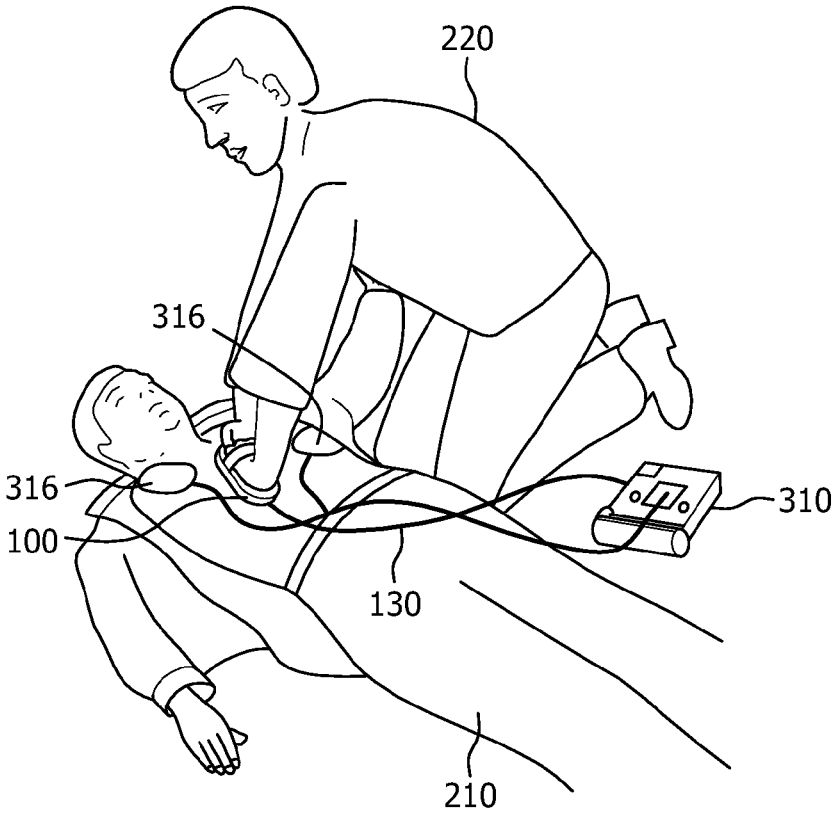
FIG. 2 illustrates the use of the CPR meter of FIG. 1 in administration of CPR chest compressions.

As shown in FIG. 2, with the CPR meter 100 placed on the sternum of a patient 210, a rescuer 220 prepares to apply CPR chest compressions in a conventional manner using two hands with one placed over the other. Instead of placing the hands directly on the patient 210, the CPR meter 100 is directly compressed by the rescuer 220, and chest compressions are applied to the patient 210 via the CPR meter 100. Chest compressions are administered by the rescuer 220 as prescribed by conventional CPR protocols or by custom protocols adopted by the rescuer or emergency medical rescue service. The CPR meter may be attached to the patient 210 by an adhesive layer 128 present on the lower side of the housing 118 (not visible in FIG. 2) of the CPR meter 100.

As also shown in FIG. 2, an AED or monitor/defibrillator 310 is attached to the patient 210 by electrodes 316. The defibrillator 310, as known, can be used to deliver defibrillating shocks to the patient 210 suffering from cardiac arrest. More specifically, the defibrillator can deliver a high-voltage impulse to the heart in order to restore normal rhythm and contractile function in patients who are experiencing arrhythmia, such as VF or VT that is not accompanied by spontaneous circulation.

The electrodes 316 are applied across the chest of the patient 210 by the rescuer 220 in order to acquire an ECG signal from the patient's heart. The defibrillator 310 then analyzes the ECG signal for signs of arrhythmia. If VF is detected, the defibrillator 310 signals the rescuer 220 that a shock is advised. After detecting VF or other shockable rhythm, the rescuer 220 then presses a shock button on the defibrillator 310 to deliver defibrillation pulse to resuscitate the patient 210. The CPR meter 100 is coupled to the defibrillator 310 by the electrical cable 130 to provide the defibrillator 310 with compression signals and physiological information obtained by sensors contained in the CPR meter 100. Alternatively, the circuitry which analyzes the compression signals and other physiological signals such as chest impedance as sensed by the electrodes 316 for detecting ventilation may be incorporated into the CPR meter and display signals coupled to the defibrillator 310 either by cable 130 or wirelessly.

Figure 3:
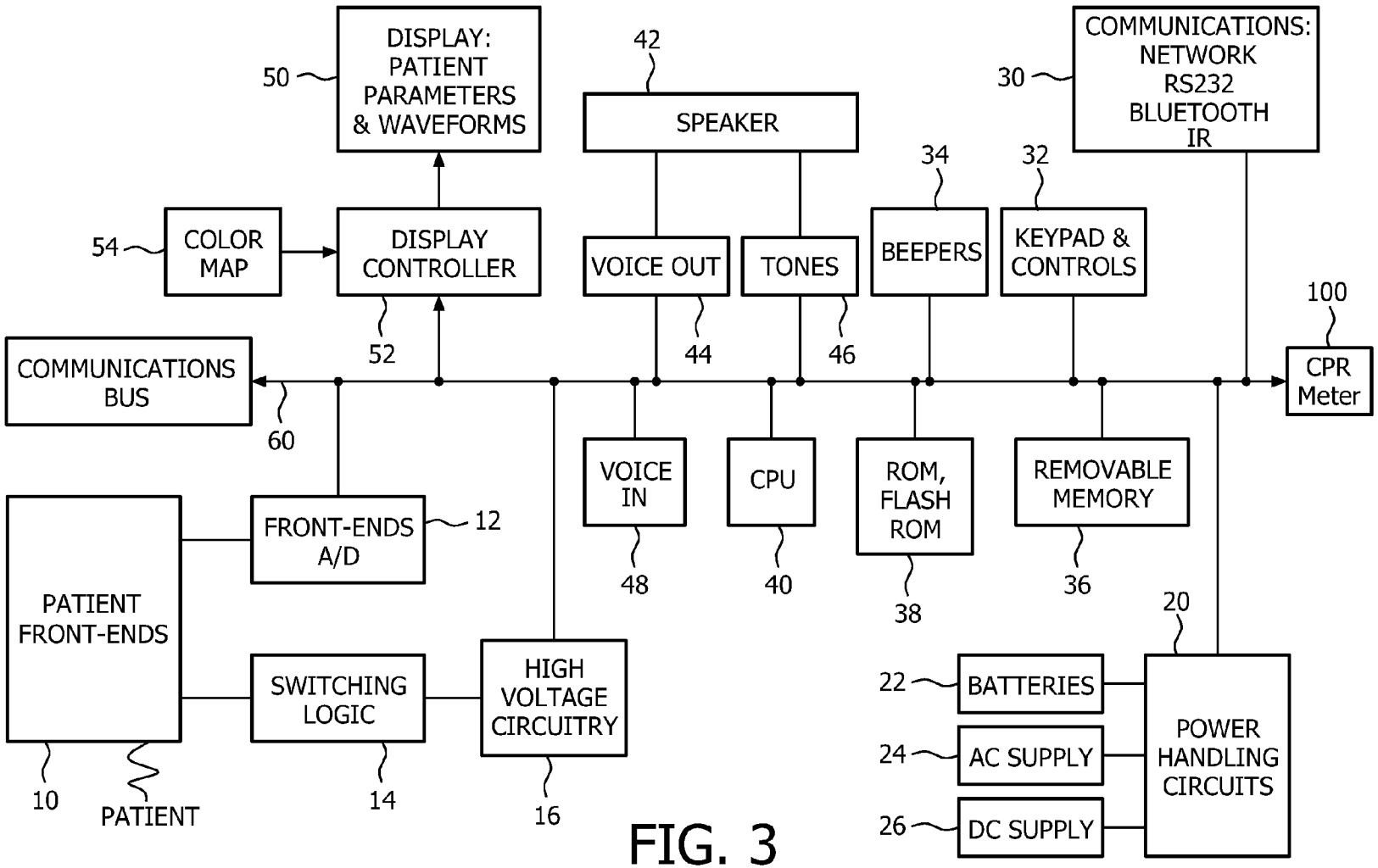
FIG. 3 is a block diagram of a defibrillator/monitor constructed in accordance with the principles of the present invention.

A monitor/defibrillator suitable for use as defibrillator 310 is shown in block diagram form in FIG. 3. The instrument shown in FIG. 3 is capable of performing defibrillation of a patient who is experiencing ventricular fibrillation. It is also capable of performing ECG monitoring including the cardiac monitoring necessary for automatic defibrillation decision-making. The illustrated monitor is also capable of $SpO_2$ oxygen sensing, noninvasive blood pressure monitoring, and end tidal $CO_2$ monitoring. Other functions such as invasive blood pressure monitoring and patient temperature monitoring may also be found in such a multi-functional instrument. In accordance with the present invention, the instrument also guides a rescuer in the proper delivery of CPR.

The monitor/defibrillator has a plurality of patient front-ends, which are input circuitry for the sensors attached to the patient. This circuitry includes conventional sensing and amplification circuitry for ECG electrodes, for optical oxygen sensors, for pressure sensing and for carbon dioxide sensing, among others. The information received by the patient sensors and the front-end circuitry 10 is digitized by front-end A/D converters 12 if the signals are not already in digital form. The digitized information is coupled to processing circuitry of the instrument by a communications bus 60 which connects data between the various modules of the instrument. In accordance with the present invention, signals produced by the CPR meter 100 on the progress and effectiveness of CPR are also coupled to the bus 60, either by a wired connection or a wireless connection.

The monitor/defibrillator instrument includes high voltage circuitry 16 for defibrillator operation. The high voltage circuitry produces the high voltage pulses necessary for defibrillation which are connected at the appropriate times by switching logic 14 to defibrillator electrodes 316 applied to the patient. This circuitry provides the high voltage shocks needed to disrupt the ventricular fibrillation and return the heart to a normal rhythm. The shock level and waveform delivered for defibrillation can be automatically calculated by a processor in the monitor or can be manually set with the controls of the instrument by an experienced medical technician or physician.

Power for the modules within the monitor/defibrillator instrument is distributed by power handling circuits 20. The power handling circuits 20 will distribute power from batteries 22, from an AC supply 24, or from a DC supply 26. The AC and DC supplies are also coupled to circuitry which charges the batteries when the monitor is powered from these external power sources.

The information obtained by the instrument may be sent to other instruments or locations by communications circuitry 30. This may include a network connection, an RS232 connection, and/or a wireless connection (e.g. Bluetooth, WiFi or infrared, etc.). The communications circuitry may also be used to communicate with the CPR meter 100.

The monitor/defibrillator instrument is operated and adjusted by means of a keypad and controls 32. In a constructed embodiment the keypad is a membrane keypad providing integrity against environmental conditions. Controls such as an on/off switch, power level and shock delivery controls for defibrillation, a printer, and other functions may also be provided. As described below, these controls may be used to configure the monitor/defibrillator for a specific CPR protocol and for the particular type of CPR progress display favored by a rescuer.

The monitor/defibrillator is operated under control of a central processing unit (CPU) 40. The CPU runs software stored on a read-only memory (ROM) 38. Flash ROM is also provided for the control of feature setups and new or special capabilities such as waveform information. Removable memory 36 is provided for storage of information generated during a patient episode. Patient information such as cardiac waveforms before and after defibrillation are also stored on the removable memory 36, which can be removed and given to a subsequent care-giver for review, record-keeping, and subsequent diagnosis. The removable memory 36 can also record voice information from a care-giver speaking into a microphone 48.

Beepers 34 are used to drive a solid-state sound source that produces short "chirping" sounds. These sounds indicate that the instrument's resident self-test has detected a low battery level or a malfunction in a patient-critical circuit group. There is also a dedicated display on the front of the instrument that presents a large, flashing, red X to indicate a low battery level or a large, fixed, red X to identify a circuit failure.

Tones 46 are produced by the software and then used to drive the speaker 42. This capability is used during certain monitoring functions such as in the production of a short tone in response to each heart cycle. Combinations of tones are used to issue audible alerts and alarms when a patient's vital measurements fall outside the alarm limits selected. The speaker 42 can reproduce pre-recorded voice instructions and information stored and reproduced from voice out circuitry 44.

In accordance with the principles of the present invention a display 50 is provided for the display of information needed by a rescuer to meet the protocols established for CPR by the rescuer's hospital or rescue service. Currently available devices force users to calculate elapsed time on their watch or from the time displayed on the defibrillator/monitor, or to manually count compressions. In accordance with the present invention the display 50 includes a CPR protocol timer that includes a graphical presentation of the programmed time or count, such as a progress bar. Also displayed is the elapsed time in hours, minutes, and seconds that CPR has been performed, which may be the current CPR interval, the total amount of CPR time, or both. The display 50 further includes a compression counter that counts the total number of compressions delivered during a CPR interval.

An implementation of the present invention includes a graphical display of the programmed CPR time, a standard digital clock type display of the elapsed time of the CPR interval, and a compression counter. This information can be used separately or together to provide a CPR rescuer with rapid and accurate information about the progress and effectiveness of CPR. In one embodiment a progress bar fills in according to the pre-programmed CPR time or compressions to be applied. Included within the progress bar is the displayed CPR time that is displayed as elapsed time in hours, minutes, and seconds, as well as a compression counter that increments with each compression delivered. The CPR time and compression count will continue to increment appropriately even after the configured time expires as displayed by the progress bar. Alternatively, when the progress bar is configured to increment with each compression, the elapsed time of the CPR interval is shown in an adjacent display.

Alternatively, the displayed time or compression count may count down from the pre-programmed CPR time or total compressions to zero rather than up. Upon reaching zero, the displayed time or count can stop, or it can begin counting up with a special indication indicating this is "extra" CPR time or compressions, e.g., +0:43 seconds or +20 compressions. The graphically display information can be controlled by either the compression count or by the elapsed CPR time, as configured by a user.

Figure 4:
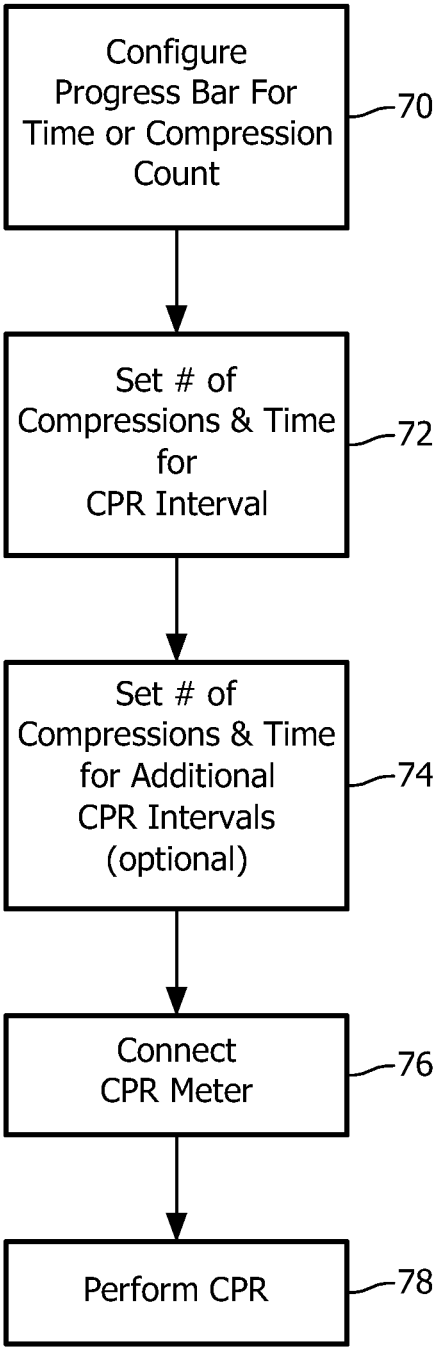
FIG. 4 is a flowchart of the steps in configuring and operating a CPR meter display in accordance with the principles of the present invention.

FIG. 4 illustrates a typical sequence of steps when using a CPR meter and display in accordance with the principles of the present invention. The first step 70 is to configure the defibrillator display progress bar to display either elapsed time of a CPR interval or the number of compressions applied. This is generally done by entering a "configuration mode" of the defibrillator. In a constructed embodiment the defibrillator comes from the manufacturer pre-configured for a CPR protocol recommended by the American Heart Association (AHA), for two minute CPR intervals. During the CPR interval 200 chest compressions are to be applied at a preferred rate of 100 compressions per minute. The display is pre-configured for the progress bar to show the elapsed time of the CPR interval, counting up from zero and progressively filling the progress bar until it is completely filled at two minutes. The user can accept this configuration or select the alternate configuration in which the progress bar is incrementally filled with each chest compression until the bar is completely filled at a count of two hundred compressions. After the user makes a selection of the type of information to be displayed, the user can select whether to have the progress bar count up or down as time elapses or compressions are applied.

Still in the configuration mode, the user will set the number of compressions to be applied and the total time of the CPR interval as shown in step 72. The user can accept the pre-configured values of a two minute CPR interval and two hundred compressions, or can select other values, as directed by the rescue protocols in use by the user's rescue service or hospital. The user could configure the CPR interval to have a duration of five minutes, for instance, and the number of chest compressions to be applied at four hundred. Other parameters may be selected or reset in accordance with adopted protocols or the adoption of new CPR protocols by the physician or institution.

At this point the user may exit the configuration mode, and every CPR interval will be in accordance with the time and count variables set in step 72. Optionally, the user may set the number of compressions and CPR interval times for additional CPR intervals as shown in step 74. This enables the user to program the instrument for sequences of differing CPR intervals. For example, the rescuer's institution may use a protocol that calls for the first CPR interval to last for five minutes during which five hundred chest compressions are applied. The protocol may call for subsequent CPR intervals to last two minutes for the application of two hundred chest compressions. The user will repeat step 74 until the parameters of sequential CPR intervals are set in accordance with his or her desired protocol. When this programming is finished, the user can name the protocol and save it under its identified name. In this manner, the instrument can store multiple pre-programmed protocols, which can be selected for use simply by recalling and selecting a desired pre-programmed and named rescue protocol.

After protocol configuration as described above is finished, the instrument is ready to execute the configured protocol with the next rescue. When an incident occurs and the CPR meter and defibrillator are needed for a rescue, the CPR meter 100 is connected to the defibrillator 310 in step 76, the electrodes and CPR meter are applied to the patient, and CPR can be performed in conjunction with ECG analysis and appropriate electrotherapy in step 78.

Figure 5:
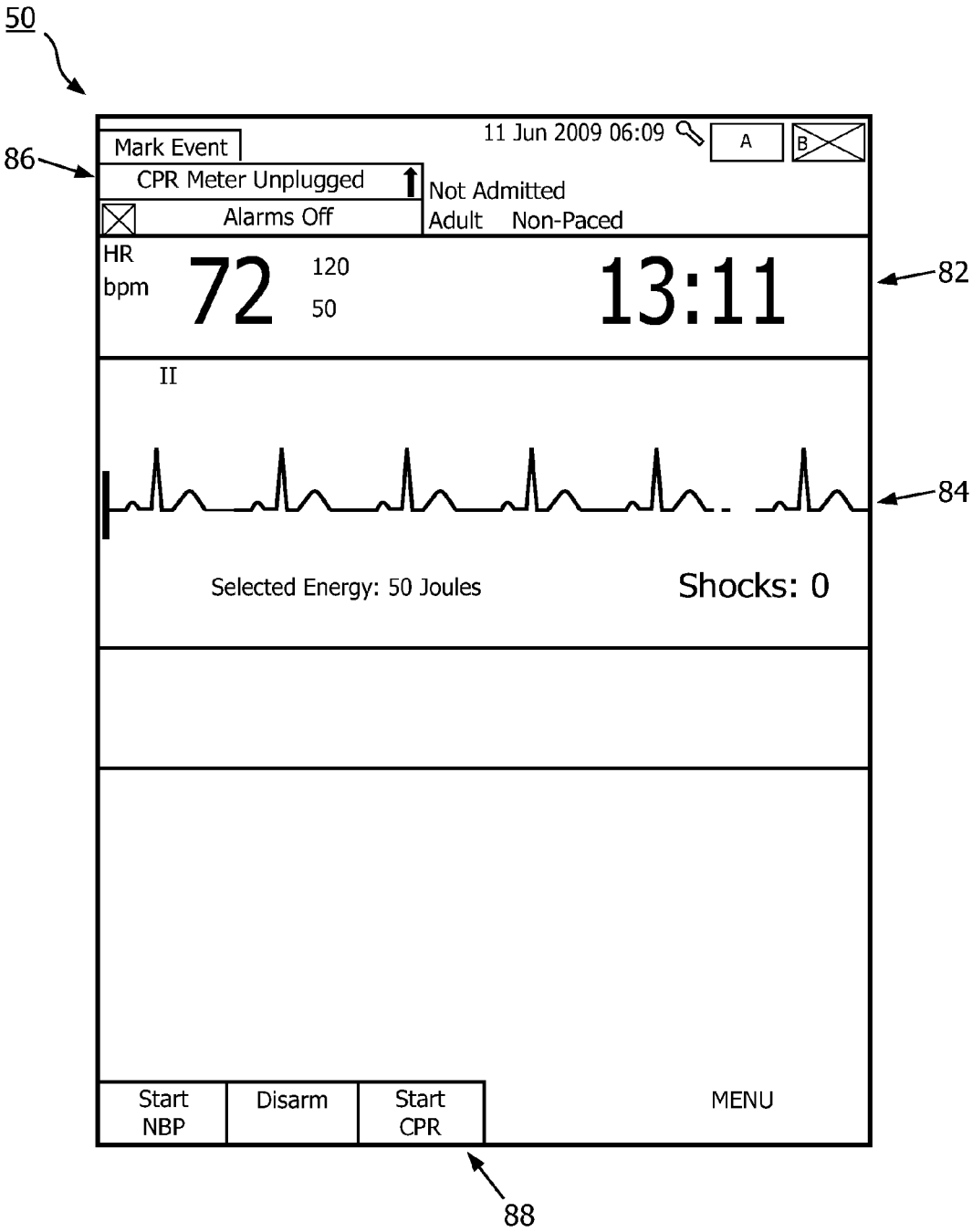
FIG. 5 illustrates a display screen of a defibrillator/monitor of the present invention prior to the start of a CPR interval.

FIG. 5 illustrates the display screen 50 of a monitor/defibrillator constructed as illustrated in FIG. 3 and on which the present invention has been implemented. When the monitor/defibrillator is turned on an incident elapsed time counter 82 starts counting elapsed time for the incident. This parameter is useful when considering "down" time, the time that the patient has been unconscious, or at least the time since the monitor/defibrillator was initially activated to treat the patient. To the left of the elapsed time counter 82 are two measurements made with the monitor/defibrillator, a heat rate measurement of 72 and a blood pressure measurement of 120 over 50. In the area of the display below these parameters is a display of the patient's ECG waveform 84. The information below the ECG waveform tells the rescuer that the energy select control for a defibrillation pulse is set at 50 Joules, and that zero defibrillating shocks have been delivered to the patient. The display areas below this information is blank in this example.

FIG. 5 also illustrates two CPR-related areas of the display screen. One is a system status notification 86 at the top of the display which informs the rescuer that the CPR meter is currently unplugged and not connected to the monitor/defibrillator. At the bottom of the display is a button identified at 88 as "Start CPR," This button identifies the current function of a hardkey immediately below the button display which, when depressed, will start a CPR interval. In this example actuation of this button is not necessary to start a CPR interval, as a CPR interval will start automatically once the rescuer begins delivering chest compressions against the attached CPR meter 100. Actuating the button will cause the display to begin displaying the CPR interval display shown in FIG. 6. The CPR interval display appears automatically with the commencement of chest compressions.

Figure 6:
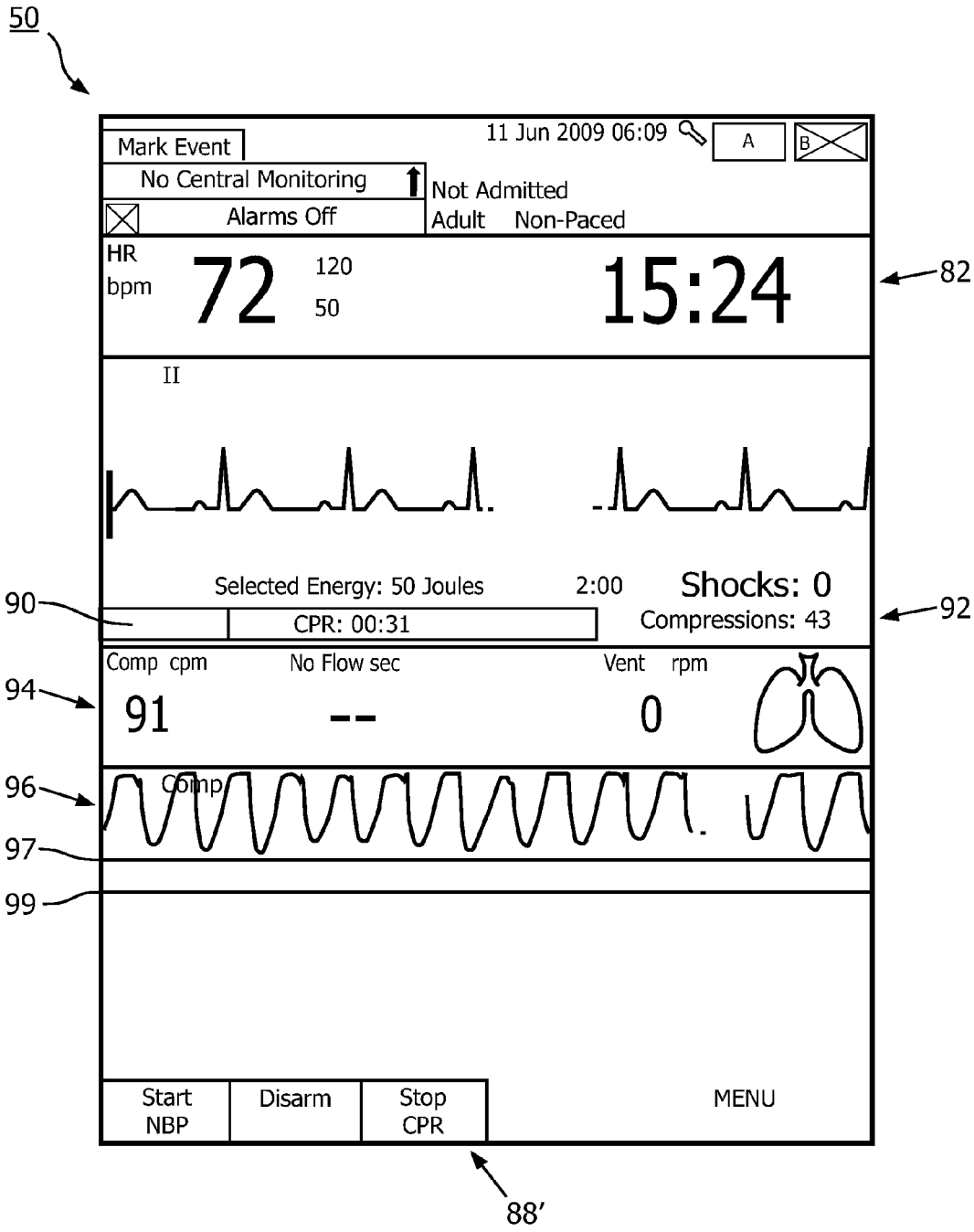
FIG. 6 illustrates the display screen of FIG. 5 during the administration of CPR.

FIG. 6 shows the monitor/defibrillator display 50 after a CPR interval has commenced and the CPR interval display is being displayed. A CPR progress bar 90 is shown at the mid-level of the display which graphically illustrates the progress of CPR during the current CPR interval. In this example the progress bar is outlined in white and initially filled in black, and begins to fill from left to right with white as CPR progresses. The progress bar is configured in this example to show elapsed time. It is seen that in this illustration about the left one-quarter of the progress bar 90 has been filled, showing the rescuer at a glance that the rescuer is about one-quarter through the interval. The graphics inside the bar show the elapsed time quantitatively, in this case, thirty-one seconds. At the right end and just above the progress bar is the total time of the CPR interval, which is two minutes (2:00) in this example. As the white filling of the progress bar reaches and continues through the graphics inside the bar, the white graphics change to black to be distinctly visible against the white filling of the progress bar. To the right of the progress bar 90 is the compression counter 92 which shows that, at this point in the CPR interval, forty-three compressions have been administered to the patient.

Figure 7:
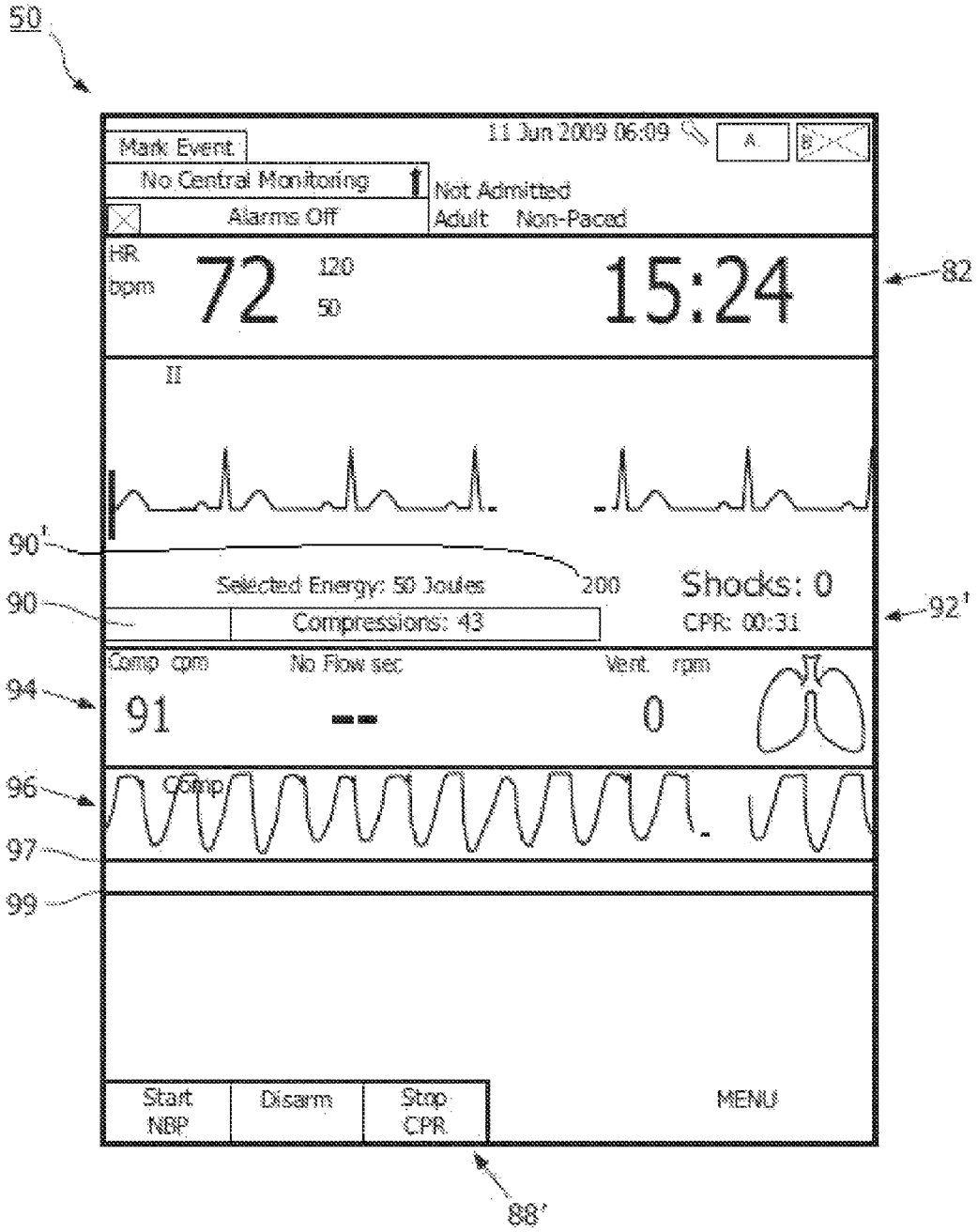
FIG. 7 illustrates another embodiment of the display screen of FIG. 5 during the administration of CPR.

In the other configuration described above and illustrated in FIG. 7, the progress bar will incrementally fill with each chest compression. Instead of the maximum time graphic at the right side of the bar, the maximum compression count 90' is shown, e.g., two hundred (200) compressions for the full CPR interval. The progress bar will thus increment one two-hundredth of its area with each chest compression applied to the patient. The "Compressions" graphic 92 is replaced in this case with the time elapsed 92' during the current CPR interval.

Below these graphics in display area 94 are other measures of CPR performance. The numeral "91" is the rate of chest compressions in compressions per minute. The "No Flow sec" graphic gives the elapsed time when no blood flow has been promoted in the patient's body during the CPR interval, as measured by the duration of a break in chest compression administration. If the rescuer pauses to rest for five seconds during chest compressions, this graphic will indicate that now blood flow has been promoted in the patient's body for five seconds, for instance. To the right of this metric is the measure of ventilations in respirations per minute. In this example this parameter is zero, as the patient in this example is not being ventilated during this CPR interval. To the right of the ventilation graphic is a lung icon which illustrates the filling of the patient's lungs during ventilation, as described in US patent publication no. US2009/0024175 (Freeman).

Below this information is a graphical illustration 96 of chest compression depth. This waveform dips downward with each chest compression, and upward when a compression is released. The lines 97-99 delineate a desired depth for the compressions, nominally 6 cm. for adults. The rescuer can observe the valleys of each compression and try to have the valleys dip so that they reach the area between lines 97 and 99 on the display. In this example it is seen that the valley of each compression is above line 97, which means that the rescuer is not compressing the patient's chest to a sufficient depth for the most effective CPR.

After the progress bar has filled completely and the CPR interval has ended, the rescuer can depress the Stop CPR button 88' to return the CPR display areas of the display to the display of other patient parameters such as $CO_2$ and $SpO_2$.

Variations of the concepts of the present invention will readily occur to those skilled in the art. For example, the progress bar can be incremented by considering both elapsed time and the number of compressions delivered. If the rescuer had been administering compressions for half (50%) of the required time but had only delivered 40% of the required compressions, a weighted progress of 45% could be shown by the progress bar.

What is claimed is:

1. A CPR device which tracks a progress of cardiopulmonary resuscitation (CPR) during a CPR interval having a desired duration comprising:

a sensor which senses an application of chest compressions to a patient; and a CPR display, responsive to sensed chest compressions, including a progress bar which is filled to graphically illustrate an elapsed time of the CPR interval of the desired duration, wherein the CPR display is progressively updated in real time to illustrate the progress of CPR during the CPR interval, wherein the CPR display begins with a representation of zero at a start of the CPR interval and is incremented toward the desired duration of a total time of the CPR interval during the CPR interval.

2. The CPR device of claim 1, wherein the CPR display further comprises a numeric illustration of the elapsed time of the CPR interval.

3. The CPR device of claim 1, further comprising a numeric illustration of the elapsed time of the CPR interval located on the progress bar.

4. The CPR device of claim 1, wherein the CPR display further comprises a display of the number of chest compressions applied to the patient during the CPR interval.

5. The CPR device of claim 1, wherein the CPR display begins with a representation of the desired duration of the CPR interval and is decremented toward zero during the CPR interval.

6. The CPR device of claim 1, wherein the CPR device is further operable in a configuration mode for selecting the graphic illustration by the CPR display of either elapsed time of a CPR interval or the number of chest compressions applied during a CPR interval.

7. The CPR device of claim 1, wherein the CPR device is further operable in a configuration mode for selecting the desired duration of a CPR interval.

8. The CPR device of claim 1, further comprising a memory device which is operable to store a CPR protocol comprising at least one of the duration of a CPR interval or the number of chest compressions to be applied during a CPR interval.

9. A CPR device which tracks a progress of cardiopulmonary resuscitation (CPR) during a CPR interval comprising:

a sensor which senses an application of chest compressions to a patient;

a CPR display, responsive to sensed chest compressions, including a progress bar which is filled to graphically illustrate a number of chest compressions applied during the CPR interval consisting of the total number of chest compressions to be applied during a full CPR interval, wherein the CPR display is progressively updated in real time to illustrate the progress of CPR relative to the full CPR interval.

10. The CPR device of claim 9, wherein the CPR display further comprises a numeric illustration of the number of chest compressions applied during the CPR interval.

11. The CPR device of claim 9, wherein the CPR display further comprises a display of the elapsed time of the CPR interval.

12. The CPR device of claim 9, wherein the CPR device is further operable in a configuration mode for selecting the total number of chest compressions to be applied during a CPR interval.

* * * * *